US008424509B1

(12) United States Patent
Davis

(10) Patent No.: US 8,424,509 B1
(45) Date of Patent: Apr. 23, 2013

(54) FUEL INJECTOR CUP ROTATION LIMITING STRUCTURE FOR AN ISOLATED FUEL RAIL SYSTEM

(75) Inventor: George Marcus Davis, Chesapeake, VA (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 5 days.

(21) Appl. No.: 13/284,113

(22) Filed: Oct. 28, 2011

(51) Int. Cl.
*F02M 61/14* (2006.01)

(52) U.S. Cl.
USPC ..... 123/470; 123/469

(58) Field of Classification Search ..... 123/468, 123/469, 470
See application file for complete search history.

(56) References Cited

U.S. PATENT DOCUMENTS 5,172,671 A * 12/1992 Peters et al. ..... 123/470
5,735,247 A * 4/1998 Tsuzuki et al. ..... 123/470
6,073,612 A * 6/2000 Ohkubo et al. ..... 123/456
6,314,943 B1 * 11/2001 Burch et al. ..... 123/470
6,772,736 B2 * 8/2004 Liskow ..... 123/470
7,886,717 B2 * 2/2011 Rettig et al. ..... 123/470
8,074,624 B2 * 12/2011 Hohkita et al. ..... 123/456
2004/0040543 A1 * 3/2004 Mickelson ..... 123/470
2005/0161025 A1 * 7/2005 Braun et al. ..... 123/470
2010/0275883 A1 * 11/2010 Hohkita et al. ..... 123/456
2010/0300408 A1 * 12/2010 Aronhalt et al. ..... 123/470

* cited by examiner

*Primary Examiner* — Erick Solis

(57) ABSTRACT

A fuel injector cup assembly (26) includes a fuel injector cup (10) having an opening (18) to receive fuel from a fuel rail (15). An open end (27) receives an inlet of a fuel injector (10) therein such that an O-ring (16) seals with the injector cup. A mounting portion (20) extends from a body (29) of the cup and mounts the cup with respect to a cylinder head. Rotation limiting structure (26) is associated with the mounting portion such that when the cup is coupled to the cylinder head and when a first moment is created about the mounting portion causing rotation of the cup with respect to the fuel injector, the rotation limiting structure will engage at least the mounting portion of the cup and create a second moment equal and opposite to the first moment, to prevent further rotation of the cup.

19 Claims, 4 Drawing Sheets

FUEL INJECTOR CUP ROTATION LIMITING STRUCTURE FOR AN ISOLATED FUEL RAIL SYSTEM

FIELD OF THE INVENTION

The invention relates to a fuel injector cup for mounting a fuel injector with respect to a fuel rail and, more particularly, to rotation limiting structure to limit rotation of the fuel injector cup in the event of a failure of the connection between the cup and injector.

BACKGROUND OF THE INVENTION

With reference to FIG. 1, a fuel injector cup 10 is used to couple an inlet 12 of a fuel injector 13 to a fuel rail 14 via a connecting tube 15. The fuel injector 13 typically includes an O-ring 16 mounted about the inlet 12. The fuel injector inlet 12 is inserted into the fuel injector cup 10 with an axial insertion force with the O-ring 16 creating a seal with the fuel injector cup 10. The fuel injector cup 10 has an opening 18 that communicates with fuel in the fuel rail 14 so as to feed fuel to the injector 13. The fuel injector cup 10 also is includes a mounting arm 20 that receives a fastener 22 and elastomeric grommets that prevent direct contact of the fuel injector cup mounting arm 20 to the cylinder head 23. The fuel injector 13 is thus isolated from making direct contact with the cylinder head 23.

FIG. 2 shows the assembled forces (arrows A) on the fuel injector cup 10. The fuel rail 14 and fastener 22 is not shown in FIG. 2. If there is a failure of the connection between the fuel injector 13 and the fuel injector cup 10, the upward force (arrow B) exerted by hydraulic pressure pushing down onto the fuel injector 13 will begin to rotate the fuel injector cup 10 about the fastener 22 (FIG. 1) creating a moment (arrow C). Since the outlet end 24 of the injector 13 is coupled with a manifold (not shown) the rotation of the fuel injector cup 10 may cause the O-ring 16 to extrude from the fuel injector cup 10 and thus cause the loss of the O-ring/cup seal.

There is a need to provide a fuel injector cup with structure to limit rotation of the cup in the event of a failure of the connection between the cup and the fuel injector to ensure an O-ring remains sealed with the cup.

SUMMARY OF THE INVENTION

An object of the invention is to fulfill the need referred to above. In accordance with the principles of the present invention, this objective is obtained by providing a fuel injector cup assembly for mounting to an engine cylinder head of a vehicle. The fuel cup assembly includes a fuel injector cup having a longitudinal axis; an opening constructed and arranged to receive fuel from the fuel rail when associated with the fuel rail; an open end constructed and arranged to receive an inlet of a fuel injector therein such that an O-ring of the fuel injector inlet may seal with the injector cup; and a mounting portion extending from a body of the fuel injector cup in a cantilever manner. The mounting portion is constructed and arranged to be used to mount the fuel injector cup with respect to the engine cylinder head. Rotation limiting structure is associated with at least the mounting portion. The rotation limiting structure is constructed and arranged such that when the fuel injector cup is coupled to the cylinder head via the mounting portion and when a first moment is created about the mounting portion causing rotation of the fuel injector cup with respect to the fuel injector, a portion of the rotation limiting structure will engage at least the mounting portion of the fuel injector cup and create a second moment equal and opposite to the first moment, to prevent further rotation of the injector cup.

In accordance with another aspect of a disclosed embodiment, a method of preventing an O-ring of an inlet of a fuel injector from extruding from a fuel rail cup provides the fuel injector cup to have an opening associated with a fuel rail to receive fuel from the fuel rail. The fuel injector cup has a mounting portion extending from a body of the fuel injector cup in a cantilever manner. The inlet of the fuel injector is mounted in the fuel injector cup so that the O-ring is in sealed engagement with the fuel injector cup. Rotation limiting structure is associated with at least the mounting portion. The mounting portion is coupled together with the rotation limiting structure to a portion of a cylinder head such that, when a first moment is created about the mounting portion due to a connection failure between the fuel injector and fuel injector cup that causes rotation of the fuel injector cup with respect to the fuel injector, a portion of the rotation limiting structure will engage at least the mounting portion of the fuel injector cup and create a second moment equal and opposite to the first moment, to prevent further rotation of the injector cup and thereby prevent extrusion of the O-ring from the fuel injector cup Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENTS

Figure 1:
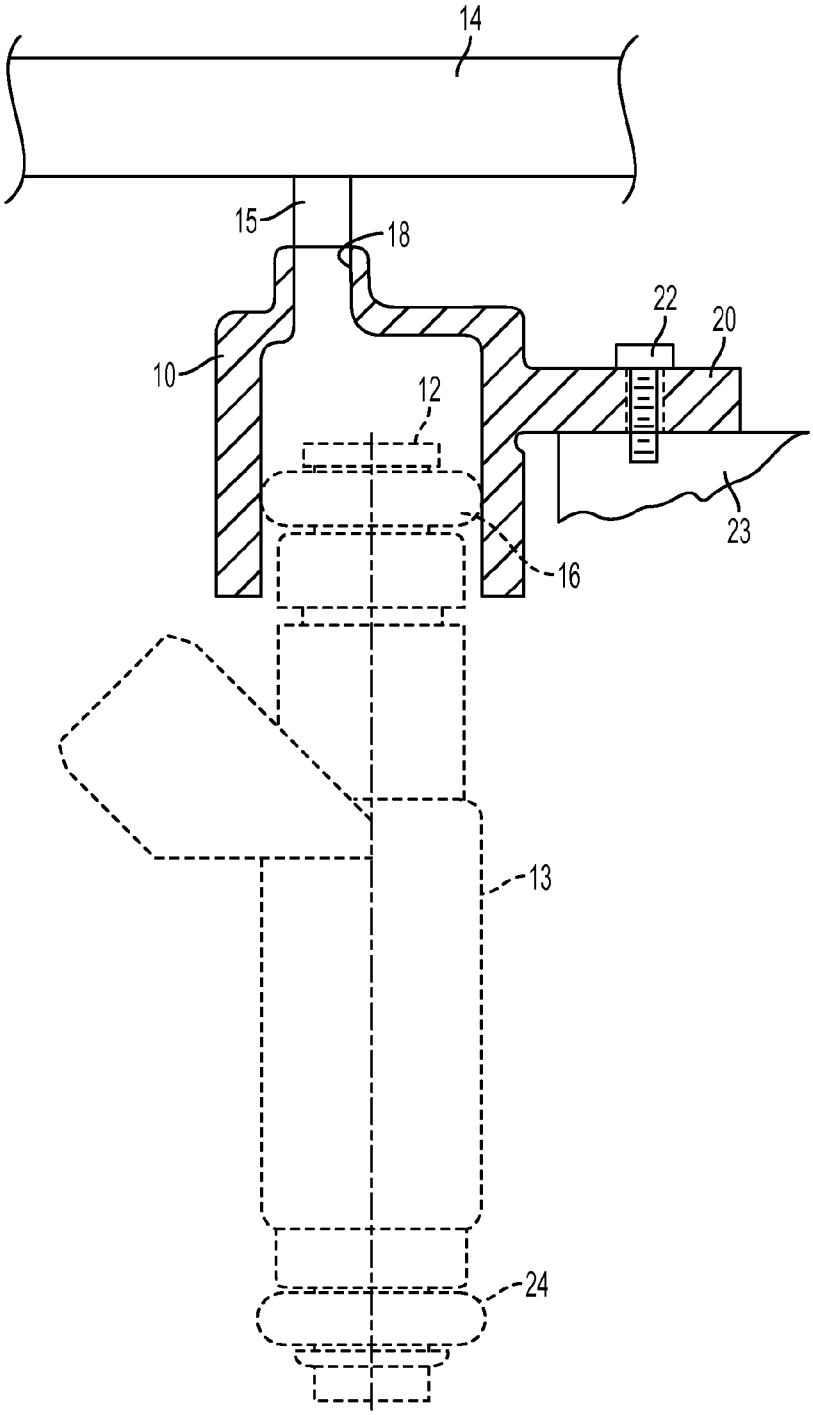
FIG. 1 PRIOR ART
FIG. 1 is a view of a conventional fuel injector cup, receiving a fuel injector therein, and mounted to a cylinder head.
Figure 2:
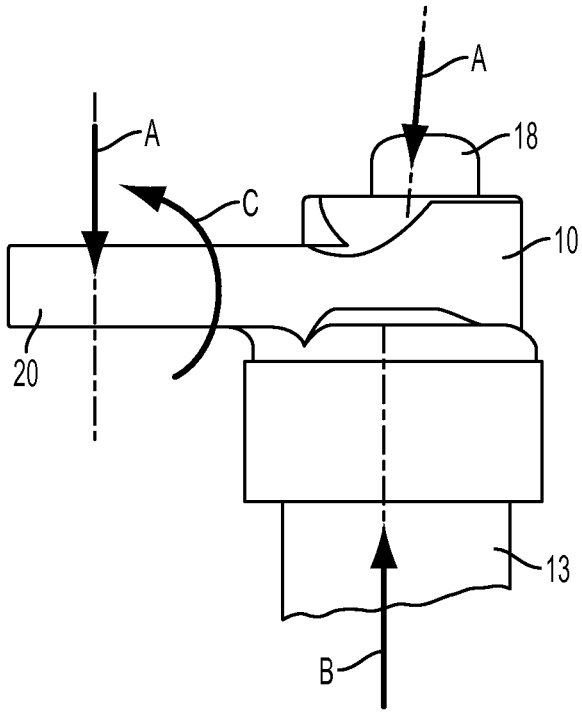
FIG. 2 PRIOR ART
FIG. 2 is a view of the fuel injector cup and fuel injector of FIG. 1, showing forces and a moment exerted on the fuel injector cup upon due to a connection failure.
Figure 3:
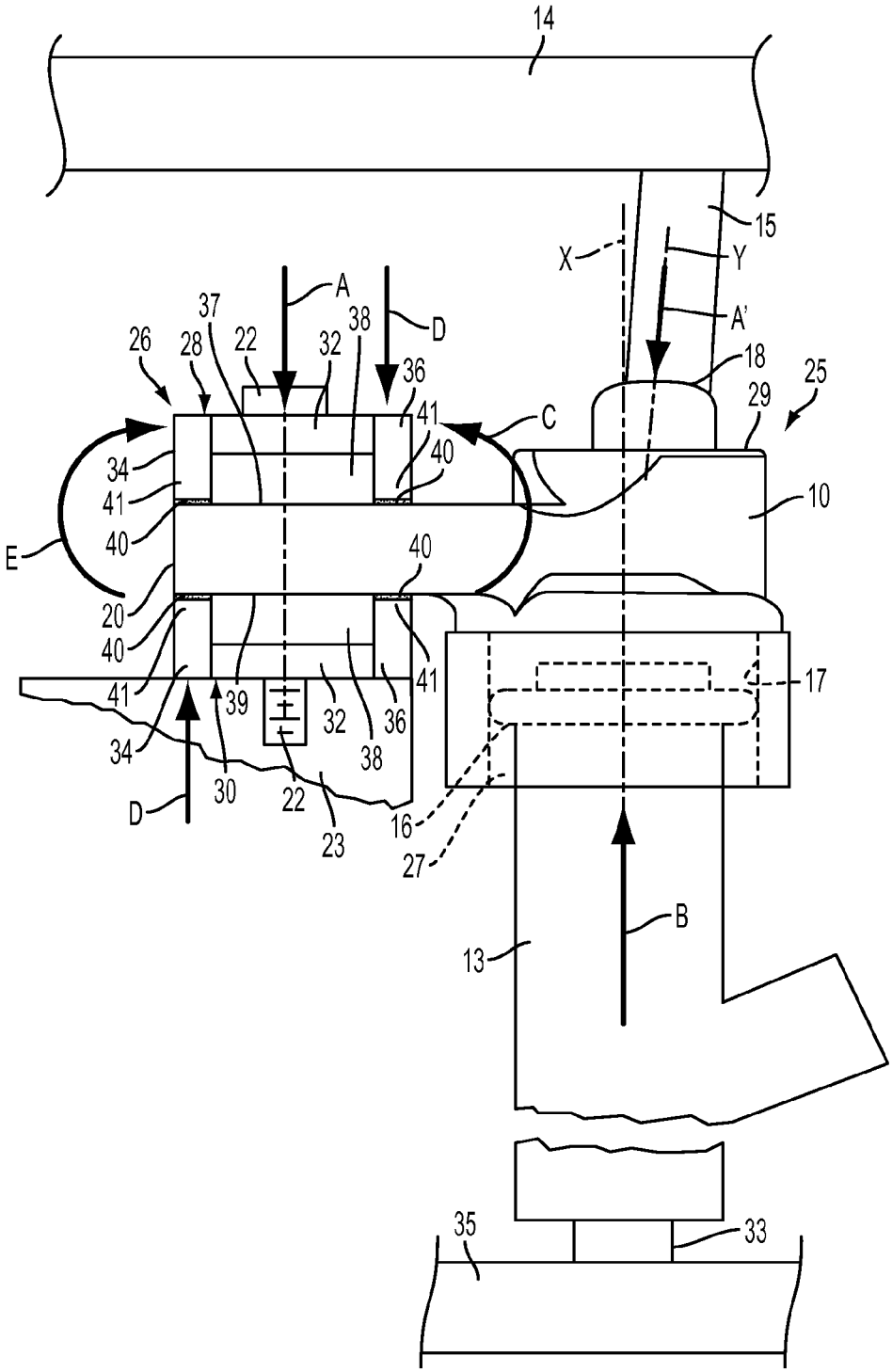
FIG. 3 is a view of a fuel injector cup assembly having an injector cup and a rotation limiting structure in accordance with an embodiment, with the cup assembly being mounted to a cylinder head.

With reference to FIG. 3, a fuel injector cup assembly is shown, generally indicated at 25, in accordance with an embodiment of the invention. The cup assembly includes an injector cup 10 and rotation limiting structure, generally indicated at 26. The fuel injector cup 10 has an open end 27 constructed and arranged to receive an inlet end of a fuel injector 13 such that an O-ring 16 is in sealed engagement with an interior surface 17 of the cup 10. The fuel injector cup 10 also has an opening 18 that is constructed and arranged to receive fuel in a fuel rail 14 of a vehicle, when coupled thereto, so as to feed fuel to the injector 13 in the conventional manner. The cup 10 includes an elongated mounting portion or arm 20 extending from a body 29 of the cup 10 in a cantilever manner. The arm 20 is connected to a mounting surface of the cylinder head 23 of the engine (not shown) of a vehicle. An outlet end 33 of the fuel injector 13 is coupled to a manifold 35 for injecting fuel into an engine.

In the embodiment of FIG. 3, the rotation limiting structure 26 is associated with a mounting arm 20 of the injector cup 10. As shown, the rotation limiting structure 26 includes a first generally C-shaped member, generally indicted at 28, and a second generally C-shaped member, generally indicated at 30. Each C-shaped member comprises a central leg 32, transverse with respect to the longitudinal axis X, a first side leg 34 and an opposing second side leg 36, with each side leg 34, 36 being coupled to ends of the central leg 32. The side legs 34 and 36 are disposed transversely with respect to the central leg 32 and have ends 41 adjacent to the mounting arm 20. An elastomer member 38 (such as a rubber washer) is provided between the central legs 32 and the mounting arm 20. The fastener 22 extends downwardly through the central legs 32, the washers 38 and the mounting arm 20 and to mount the cup 10 to the cylinder head 23.

As noted above, at the time of a failure of the connection between the cup 10 and injector 13, the upward force (arrow B) exerted by the hydraulic pressure pushing down onto the injector would begin to rotate the cup 10 about the fastener 22 creating a moment (arrow C). The moment C is created since the axis Y of the force A' is offset from the axis X of the force B. At this time, the rotation limiting structure 26 makes contact on the mounting arm 20 of the cup 10 at the shaded areas 40. Thus, ends 41 of the side legs 34, 36 of the first C-shaped member 28 engage a first surface 37 of the arm 20 and ends 41 of the side legs 34, 36 of the second C-shaped member 30 engage an opposing second surface 39 of the arm 20. Thus, the engagement of the ends 41 of the side legs 34 and 36 with the mounting arm 20 creates opposing forces (arrows D) which create a moment (arrow E). Since the moment E is equal and opposite to moment C (caused by hydraulic pressure), rotation of the cup 10 is limited, preventing a possible extrusion of the O-ring 16 from the open end 27 of the cup 10, which would destroy the seal between the O-ring 16 and cup 10.

Figure 4:
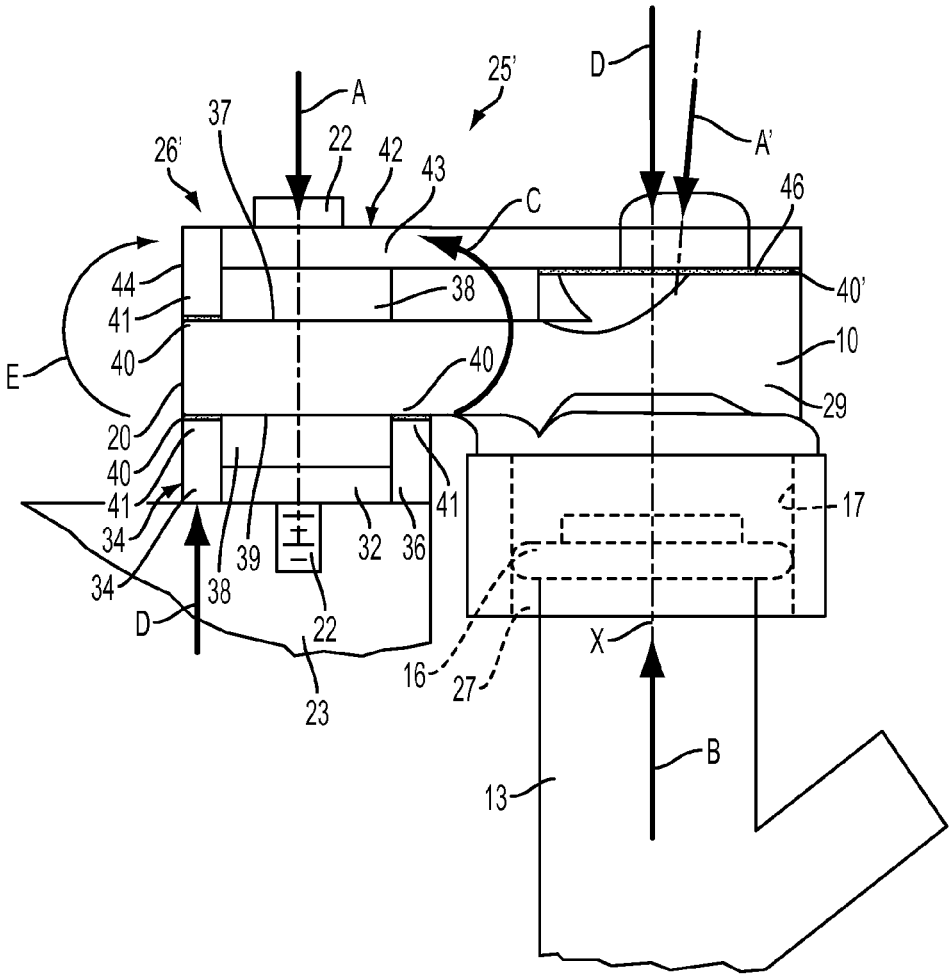
FIG. 4 is a view of a fuel injector cup assembly having an injector cup and a rotation limiting structure in accordance with a second embodiment.

In another embodiment a fuel injector cup assembly 25' shown in FIG. 4, the rotation limiting structure 26' is associated with a mounting arm 20 and the body 29 of the injector cup 10. As shown, the rotation limiting structure 26' includes a generally C-shaped member disposed adjacent to surfaces 30 of the mounting arm 20. The C-shaped member is identical to that in FIG. 3 and comprises a central leg 32, transverse with respect to the longitudinal axis X, a first side leg 34 and an opposing second side leg 36, with each side leg 34, 36 being coupled to ends of the central leg 32. The side legs 34 and 36 are disposed transversely with respect to the central leg 32 and have ends 41 adjacent to surface 30 of the mounting arm 20. The elastomer (such as rubber) washer 38 is provided between the central leg 32 and the mounting arm 20.

Instead of the C-shaped member 28 adjacent to surface 37 (as in FIG. 3), the rotation limiting structure 26' of FIG. 4 instead includes a generally L-shaped member, generally indicated at 42, comprising an elongated first leg 43 extending transversely with respect to the longitudinal axis X, and a side leg 44 coupled to an end of the first leg 43. The side leg 44 is disposed transversely with respect to the first leg 43 and has an end 41 adjacent surface 37 of the mounting arm 20. The first leg 43 extends to be adjacent to an exterior surface 46 of the body 29 of the cup 10. Surface 46 is generally transverse with respect to the longitudinal axis X. The fastener 22 extends downwardly through the central leg 32, the washers 38, the mounting arm 20, and the first leg 43. As noted above, the fastener 22 is used to mount the cup 10 to the cylinder head 23.

With the embodiment of FIG. 4, at the time of failure of the connection between the cup 10 and injector 13, the upward force (arrow B) exerted by the hydraulic pressure pushing down onto the injector would begin to rotate the cup 10 about the fastener 22 creating a moment (arrow C). At this time, the rotation limiting structure 26' makes contact on the mounting arm 20 of the cup 10 at the shaded areas 40 and with the top surface 46 of the body of the cup 10 at shaded area 40'. In particular, ends 41 of the side legs 34, 36 of the C-shaped member 30 engage the second surface 39 of the arm 20 and the side leg 44 of the L-shaped member 42 engages the first surface 37 of the arm 20, and a portion of the first leg 43 engages the surface 46 of the body 29. Thus, this engagement creates opposing forces (arrows D) which create a moment (arrow E). Since the moment E is equal and opposite to moment C (caused by hydraulic pressure), rotation of the cup 10 is limited, preventing a possible extrusion of the O-ring 16 from the open end 27 of the cup 10, which would destroy the seal between the O-ring 16 and cup 10.

Thus, it can be appreciated that the rotation limiting structure 26, 26' provides an effective way of limiting rotation of a fuel injector cup when a moment is applied to the cup. Thus, extrusion of an O-ring from the cup can be prevented.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fuel injector cup assembly for mounting to a cylinder head of an engine, the fuel cup assembly comprising:

a fuel injector cup having a longitudinal axis; an opening constructed and arranged to receive fuel from the fuel rail when associated with the fuel rail; an open end constructed and arranged to receive an inlet of a fuel injector therein such that an O-ring of the fuel injector inlet may seal with the injector cup; and a mounting portion extending from a body of the fuel injector cup in a cantilever manner, the mounting portion being constructed and arranged to be used to mount the fuel injector cup with respect to a cylinder head, and rotation limiting structure associated with at least the mounting portion, the rotation limiting structure being constructed and arranged such that when the fuel injector cup is coupled to the cylinder head via the mounting portion and when a first moment is created about the mounting portion causing rotation of the fuel injector cup with respect to the fixed fuel injector, a portion of the rotation limiting structure will engage at least the mounting portion of the fuel injector cup and create a second moment equal and opposite to the first moment, to prevent further rotation of the injector cup.

2. The assembly of claim 1, wherein the mounting portion is an elongated arm having opposing first and second surfaces that are transverse respect to the longitudinal axis.

3. The assembly of claim 2, wherein the rotation limiting structure comprises first and second generally C-shaped members, each C-shaped member including a central leg disposed transversely with respect to the longitudinal axis, a first side leg and an opposing second side leg, with each side leg being coupled to ends of the central leg and disposed transversely with respect to the central leg, wherein when the first moment is created, ends of the side legs of the first C-shaped member are constructed and arranged to engage the first surface of the arm and ends of the side legs of the second C-shaped member are constructed and arranged to engage the second surface of the arm.

4. The assembly of claim 3, further comprising an elastomer member provided between each central leg and an associated one of the first and second surfaces.

5. The assembly of claim 4, further comprising a fastener, for mounting the fuel injector cup, which extends through the central legs, the elastomer members, and the arm.

6. The assembly of claim 4, wherein the elastomer members are rubber washers.

7. The assembly of claim 2, wherein the rotation limiting structure comprises:

a generally L-shaped member comprising an elongated first leg extending transversely with respect to the longitudinal axis, and a side leg coupled to an end of the first leg, with the side leg being disposed transversely with respect to the first leg and having an end adjacent to the first surface of the arm, the first leg having a portion extending to be adjacent to an exterior surface of the body of the cup, and a generally C-shaped member disposed adjacent to the second surface of the arm, the C-shaped member including a central leg disposed transversely with respect to the longitudinal axis, a first side leg and an opposing second side leg, with each side leg being coupled to ends of the central leg and disposed transversely with respect to the central leg, wherein when the first moment is created, ends of the side legs of the C-shaped member are constructed and arranged to engage the second surface of the arm and the side leg of the L-shaped member is constructed and arranged to engage the first surface of the arm, and the portion of the first leg of the L-shaped member is constructed and arranged to engage the surface of the body.

8. The assembly of claim 7, wherein the exterior surface of the body is generally transverse with respect to the longitudinal axis.

9. The assembly of claim 7, further comprising an elastomer member provided between the central leg and the second surface of the arm, and between a portion of the first leg and the first surface of the arm.

10. The assembly of claim 9, further comprising a fastener, for mounting the fuel injector cup, which extends through the central leg, the elastomer members, the arm, and the first leg.

11. The assembly of claim 9, wherein the elastomer members are rubber washers.

12. The assembly of claim 1, in combination with 1) the fuel injector having the O-ring, 2) the fuel rail, 3) a manifold, and 4) the cylinder head, the mounting portion being mounted to a portion of the cylinder head by a fastener, the O-ring being in sealed engagement with an interior surface of the cup, an outlet end of the fuel injector being mounted to the manifold.

13. A method of preventing an O-ring of an inlet of a fuel injector from extruding from a fuel rail cup, the method comprising:

providing the fuel injector cup to have an opening associated with a fuel rail to receive fuel from the fuel rail, the fuel injector cup having a mounting portion extending from a body of the fuel injector cup in a cantilever manner, mounting the inlet of the fuel injector in the fuel injector cup so that the O-ring is in sealed engagement with the fuel injector cup, mounting an outlet end of the fuel injector to a manifold, providing rotation limiting structure associated with at least the mounting portion, and coupling the mounting portion together with the rotation limiting structure to a portion of a cylinder head such that, when a first moment is created about the mounting portion due to a connection failure between the fuel injector and fuel injector cup that causes rotation of the fuel injector cup with respect to the fuel injector, a portion of the rotation limiting structure will engage at least the mounting portion of the fuel injector cup and create a second moment equal and opposite to the first moment, to prevent further rotation of the injector cup and thereby prevent extrusion of the O-ring from the fuel injector cup.

14. The method of claim 13, wherein the mounting portion is an elongated arm having opposing first and second surfaces that are transverse respect to a longitudinal axis of the fuel injector cup.

15. The method of claim 14, wherein the rotation limiting structure is provided to comprise first and second generally C-shaped members, each C-shaped member including a central leg disposed transversely with respect to the longitudinal axis, a first side leg and an opposing second side leg, with each side leg being coupled to ends of the central leg and disposed transversely with respect to the central leg, wherein when the first moment is created, ends of the side legs of the first C-shaped member will engage the first surface of the arm and ends of the side legs of the second C-shaped member will engage the second surface of the arm.

16. The method of claim 15, further providing an elastomer member between each central leg and an associated one of the first and second surfaces.

17. The method of claim 14, wherein the rotation limiting structure is provided to comprise:

a generally L-shaped member comprising an elongated first leg extending transversely with respect to the longitudinal axis, and a side leg coupled to an end of the first leg, with the side leg being disposed transversely with respect to the first leg and having an end adjacent to the first surface of the arm, the first leg having a portion extending to be adjacent to an exterior surface of the body of the cup, and a generally C-shaped member disposed adjacent to the second surface of the arm, the C-shaped member including a central leg disposed transversely with respect to the longitudinal axis, a first side leg and an opposing second side leg, with each side leg being coupled to ends of the central leg and disposed transversely with respect to the central leg, wherein when the first moment is created, ends of the side legs of the C-shaped member will engage the second surface of the arm and the side leg of the L-shaped member will engage the first surface of the arm, and the portion of the first leg of the L-shaped member will engage the surface of the body.

18. The method of claim 17, wherein the exterior surface of the body is generally transverse with respect to the longitudinal axis.

19. The method of claim 17, further providing an elastomer member between the central leg and the second surface of the arm, and between a portion of the first leg and the first surface of the arm.

* * * * *